United States Patent [19]

Pagnozzi et al.

[11] 4,345,384

[45] Aug. 24, 1982

[54] PROCESS FOR DRYING WOOD

[76] Inventors: Vincenzo Pagnozzi, Rocchetta di Cairo Montenotte (Savona); Ernesto G. Pagnozzi, Via Camponuovo, Cairo Montenotte (Savona), both of Italy

[21] Appl. No.: 235,791

[22] Filed: Feb. 19, 1981

[30] Foreign Application Priority Data

Mar. 12, 1980 [IT] Italy ..... 67381 A/80

[51] Int. Cl.[3] ..... F26B 5/04

[52] U.S. Cl. ..... 34/16.5; 34/73; 34/76

[58] Field of Search ..... 34/15, 16, 16.5, 73, 34/76

[56] References Cited

U.S. PATENT DOCUMENTS

| | | | |
|---|---|---|---|
| 1,190,702 | 7/1916 | Banks | 34/16.5 |
| 4,194,296 | 3/1980 | Pagnozzi et al. | 34/16.5 |
| 4,223,451 | 9/1980 | Pagnozzi et al. | 34/16.5 |

*Primary Examiner*—John J. Camby

*Attorney, Agent, or Firm*—Sughrue, Mion, Zinn, Macpeak & Seas

[57] ABSTRACT

The removal of water from wood by the process of the invention is carried out by supplying sufficient quantities of heat to maintain the pressure of the environment in which the wood is disposed above atmospheric pressure, and discharging water vapor from this environment, the heat supply and the discharge of water vapor being regulated so as to maintain a succession of conditions of substantially saturated water vapor in the said environment.

5 Claims, 2 Drawing Figures

PROCESS FOR DRYING WOOD

The present invention relates to processes and for drying wood at high temperatures, that is at temperatures greater than 100° C.

Known processes of this type, whether they involve the use of hot air or superheated steam, have the disadvantage that the surface of the wood dries too quickly due to the high evaporating capacity of the high-temperature air or superheated steam. For example, in an atmosphere of superheated steam at a temperature of 110° C., the equilibrium moisture content of the wood is about 7%, just as at a temperature of 110° C. in moist air with a relative humidity of 70%, the equilibrium moisture content of the wood is also 7%. This means that under the said conditions of superheated steam or hot air, the surface of the wood is brought rapdily (in a period of several hours) to this moisture content of 7% while the heart of the wood retains substantially its initial moisture content throughout this same period of time such that a large moisture-content gradient is set up.

It is known in this branch of the art that a large moisture gradient within the thickness of the wood during the drying process is contrary to the rules for correct drying.

A further disadvantage of the known high temperature processes is that the surface of the wood exposed to the hot air or to the superheated steam is not able to rise above the limited temperature of 100° C. until the moisture content of the surface layers of the wood has been reduced.

Indeed, all the heat given up to the wood, instead of increasing its temperature beyond 100° C., brings about the transformation of the water from the liquid to the vapour phase. Thus, clearly, the mass of wood cannot be heated beyond 100° C. while the surface of the wood is wet, whereby, in these conditions, evaporation of water from the inner layers of the wood is prevented since the temperature is too low. Only when the surface of the wood has been dehydrated does the heat given to the wood produce an increase in temperature beyond 100°, starting from the surface and then passing on into the inner layers of the wood, where the water will be able to start evaporating.

However, at this point, the following two undesirable conditions have already manifested themselves:

(1) large moisture gradient, since the surface layers of the wood are anhydrous while the internal layers are wet. The surface layers of the wood thus become cemented;

(2) the water vapor which tends to be released from the interior finds a particularly impassable barrier in the surface layers which, being anhydrous, close together, occluding all the passages (cementation). At this point, the supply of heat being maintained, there is only one way for the water vapour to escape and that is to produce cracks in the wood through which the vapour may be discharged.

It is known in the art of wood drying that the ideal basic condition, (which until now has been practically unattainable) for achieving correct drying in the shortest possible time is for the quantity of water removed by evaporation from the surface of the wood to be equal to the quantity of water which migrates from the inner layers towards the wood surface.

If the quantity of water removed is greater than this, the surface of the wood becomes too dry while, if the quantity is less than this, the drying of the wood is slowed down. In practical embodiments of the known drying processes, the first of the two hypothetical cases described above occurs due to the fact that the quantity of water which migrates from the inner layers of the wood towards the exterior is extremely small, while it has not been possible to control the quantity of water removed from the wood to the required degree of fineness, whereby it has been found necessary to moisten the surface of the wood with externally-supplied water vapour from time to time.

It is also known that the quantitative displacement of water (that is the quantity of water which moves from the interior towards the surface of the wood) increases with the temperature of the wood, all other conditions being equal. Tests carried out at different temperatures have shown that, if the ligneous mass is brought to 120° C., the quantitative displacement of water is from 8 to 10 times higher that at 100° C., depending on the type of wood, provided the surface of the wood does not become cemented.

Consequently, if one could succeed in increasing the temperature of the wet, ligneous mass beyond 100° C. without cementing the surface layers of the wood, one would provide a means of drying the wood correctly at a much higher raate than has been possible until now.

The main object of the present invention is to provide a process for drying wood at high temperature which avoids the said disadvantages of too rapid drying of the surface of the wood compared with the inner layers, as well as avoiding the cementation of the surface layers due to the high temperature. A further object of the present invention is to provide a process and apparatus for drying wood at high temperature in which it is possible to meter the quantity of water which evaporates from the surface of the wood, making this equal to the quantity of water which moves from the inner layers of the wood towards the surface.

A further object of the present invention is to provide a process for drying wood in which the rate of displacement of the water from the inner layers towards the surface of the wood is increased due to the increase in temperature beyond limits previously achievable.

In order to achieve these and other objects, which will become clear from the description which follows, the present invention provides a process for drying wood at high temperature, characterised in that the stage of removing water from the wood (drying stage) is carried out by supplying a sufficient quantity of heat to maintain the pressure of the environment in which the wood is disposed above atmospheric pressure and discharging water vapour from the said environment, the heat supply and the discharge of water vapour being regulated so as to maintain a succession of conditions of substantially saturated water vapour in the said environment.

The apparatus for carrying out the invention is characterised in that it comprises a small room adapted to contain a predetermined quantity of timber to be dried, the walls of the said room having sufficient mechanical strength to withstand an internal pressure greater than atmospheric, closure means for the said room adapted to seal the room hermetically, heating means able to heat the walls of the room to a predetermined, substantially uniform temperature and valve means adapted to regulate the quantity of water vapour discharged from the said room to a desired extent.

Further characteristics and advantages of the invention will emerge from the following detailed description, with reference to the appended drawings, in which.

Figure 1:
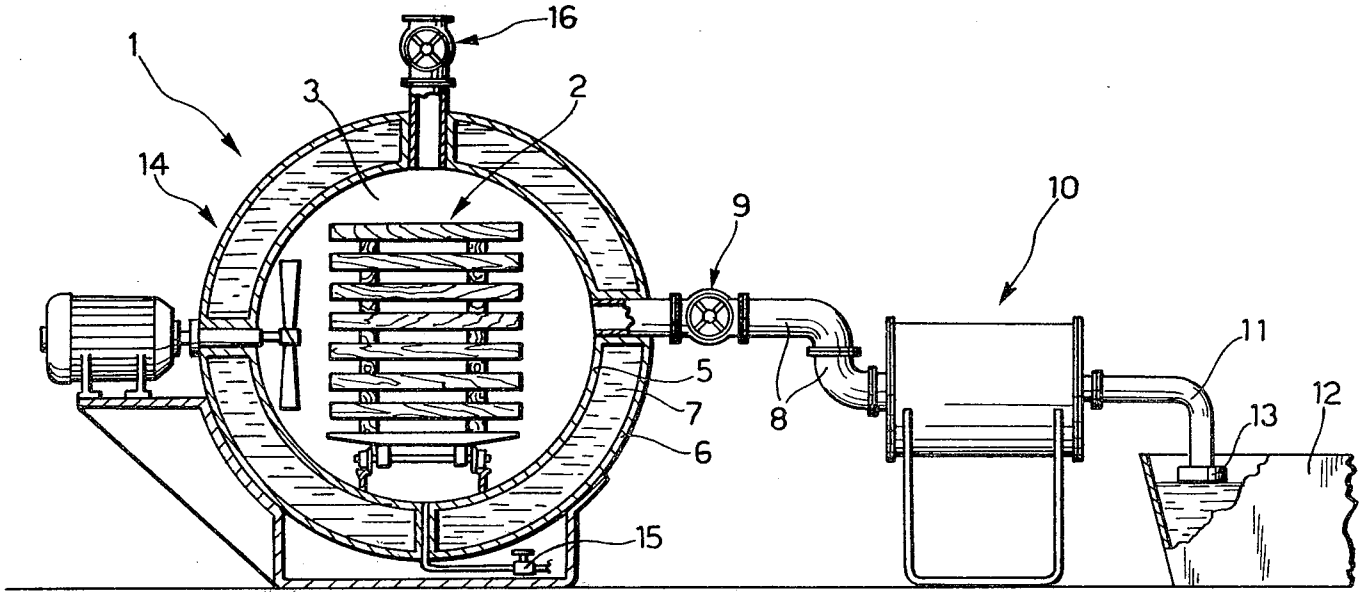
FIG. 1 is a schematic cross-sectional view of an embodiment of apparatus for carrying out a process according to the invention.

Before the various stages of the process of the invention are described, the embodiment of the apparatus adapted to carry out the said process, shown schematically in FIG. 1, will be examined.

This apparatus includes a small room 1 adapted to house within it wooden boards 2 to be dried, the boards being disposed in any convenient manner, for example in the form of a stack in which they are suitably spaced by means of fillets so that their surfaces are exposed to the fluid within the room 1.

The said room 1 has one or more small doors (not shown) for the introduction and discharge of the boards and suitable means (carriages, guides and the like) for facilitating the movement of the boards during the loading and discharge operations.

The said room and its doors are sealed so as to provide a sealed internal chamber 3; the mechanical strength of the room must be sufficient to withstand the fluid pressure therein, which, as will be stated below, are greater than atmospheric.

The room 1 conveniently has a pair of walls 5 and 6 arranged to define between them a space 7 for the circulation of a heating fluid, the fluid being fed into the space from a suitable heat source such as a heat exchanger, a boiler or the like. The room 1 conveniently has layers of heat-insulating material (not shown) arranged to reduce any heat transmission to the exterior as far as possible.

The internal chamber 3 of the room 1 may be put into communication with the external environment by means of a duct 8, there being inserted, between the latter and the chamber itself, a valve 9 with a continuously regulable open-flow cross section, which enables a discharge therethrough to the exterior to be metered quantitatively.

The duct 8 communicates with a condenser 10 which can condense the vapour which reaches it through the said duct.

A water trap 13 disposed on a discharge tube 11 at the outlet from the condenser 10 allows the liquid water phase to be discharged into a condensate-recovery tank 12.

A series of fans 14 may be disposed in any configuration within the chamber 3, as indicated schematically in FIG. 1, to create a circulatin of fluid in the chamber itself.

In the upper part of the room 1 is a manually-operable valve 16 which can put the chamber 3 into communication with the exterior.

In the lower part of the room 1 is a discharge duct closed by a manually-operable valve 15.

The process of the invention, carried out with the use of the apparatus described, is as follows.

After a suitable stack of wood 2 has been disposed in the chamber 3 of the room 1, the doors are closed but the valve 16 is left open.

A certain quantity of water (about 100 liters per cubic meter of timber stacked in the room) is introduced initially into the lower part of the room 1, conveniently through the bottom valve 15. Meanwhile the heating fluid is circulated within the space 7 so as to bring the inner wall 5 of the room 1 to a predetermined temperature greater than 100° C. without activating the fans. The water disposed in the lower part of the room 1 starts to evaporate and the water vapour differs into the chamber 3, rising from the bottom.

The air, being lighter than the steam, is displaced upwardly and is discharged through the valve 16 which is left open.

After several minutes, when all the air has been discharged, a plume of steam will be seen to be emitted through the valve 16 which is then closed and the pressure in the room 1 starts to increase slowly.

At this point the first stage of preheating the wood starts.

The steam which diffuses in the chamber 3, not being able to condense on the walls of the room 1 since their heating is maintained, starts to condense in large quantities on the boards of wood which initially are cold. The latent heat of condensation produces rapid heating of the boards. As the wood becomes hotter, the quantity of vapour which condenses on the boards diminishes and hence the pressure within the room 1 increases more and more rapidly until the desired operating pressure above atmospheric pressure is reached.

At this point the heating is stopped to be restarted when the pressure tends to fall. A practically constant pressure may easily be maintained with the use of a conventional pressure switch which controls the heat source while the wood is heated throughout its thickness from the outer layers inwardly towards the innermost layers.

The first preheating stage ends when the entire mass of wood (and, with this, the water in the wood) is heated to the same temperature as the steam throughout the entire thickness of the boards. The water vapour then ceases to condense on the wood and the internal pressure of the room 1 tends to rise sharply. At this point the valve 15 is opened for the time necessary to discharge the residual liquid water in the lower part of the room 1 and then is immediately closed, while the fans 14 are activated.

At the end of the preheating stage, the water vapour in the room 1 and the liquid water in the wood are in such conditions of thermodynamic equilibrium as are due to saturated water vapour and the three parameters which characterise these conditions (pressure, temperature and volume) are linked by the laws governing saturated water vapour.

It is important to note that from the very beginning, during the whole preheating stage, the wood has not given up even the smallest amount of its own moisture content.

This phenomenon is due to the fact that, while the wood is heated, the pressure of the water vapour in the room 1, under the process of the invention, is such as to prevent the evaporation of the water from the wood, since, at every instant, the pressure is greater than the saturated water vapour pressure corresponding to the temperature reached by the water in the wood.

At the end of the preheating stage, this vapour pressure reaches the value of the pressure existing in the room 1 without surpassing it, whereby there is still no evaporation of the water from the wood.

Figure 2:
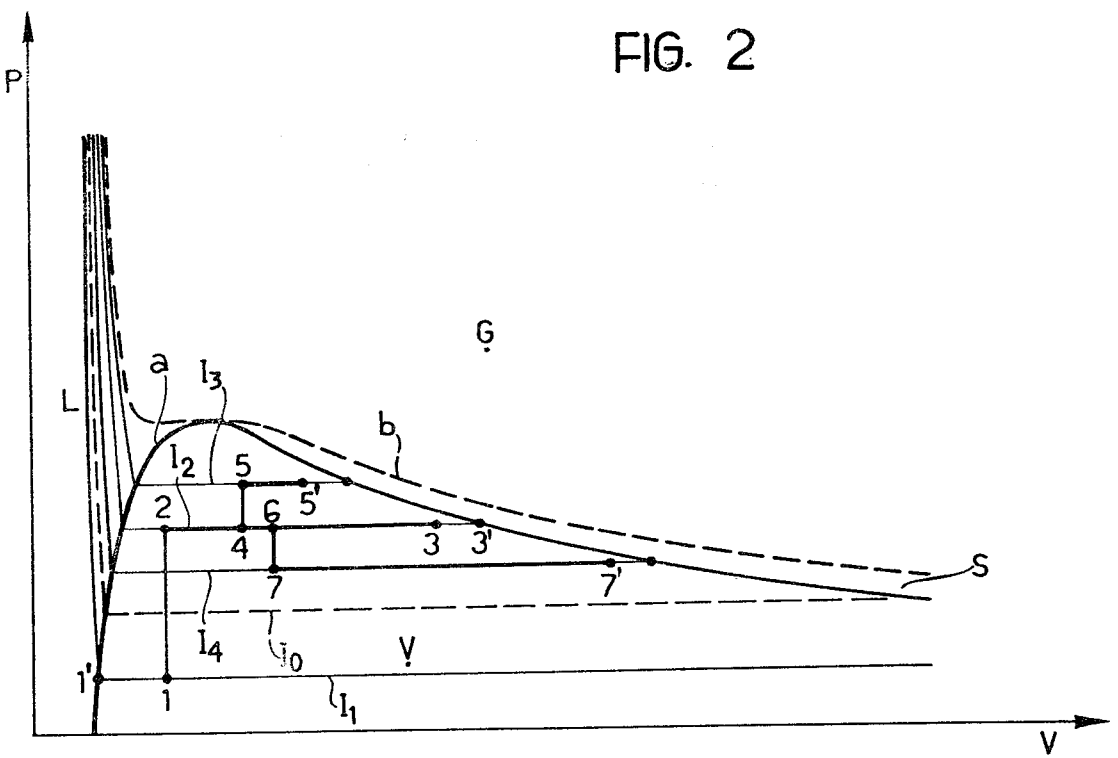
FIG. 2 is a diagram designed to illustrate the phenomena which occur in stages which are fundamental to the process according to the invention.

The various stages of the process may be followed more clearly if reference is made to the water-vapour equilibrium diagram in FIG. 2, the pressure P and the volume V being given on the coordinates. In this diagram the limit curve of the saturated vapour and the critical isotherm are indicated by a and b respectively; the two said curves define, in known manner, four characteristic zones L, V, S and G in the plane P, V corresponding respectively to the liquid phase, saturated vapour, superheated vapour and gas.

A point representative of the conditions which exist at the beginning of the preheating stage may be that indicated by 1 in the plane P, V; this point 1 is on an isotherm $I_1$ (for example at 20° C.) within the saturated vapour zone V: it is noted that the point 1 is very close to the point 1' on the limit curve; this corresponds to the fact that initially the quantity of water vapour is nearly 0.

During the preheating stage, which according to the preceding description takes place at constant volume V, the supply of heat can produce only an increase in pressure P, whereby it may be considered that the preheating stage passes through the succession of states represented by the points on the section 1–2. This latter point is on a chosen operational isotherm $I_2$, at a temperature greater than 100° C., for which the corresponding pressure P is greater than atmospheric.

Since it is desired to remain in a stalemate condition at the end of the preheating stage at point 2 (which corresponds to the fact that the moisture content of the wood remains unaltered) it suffices to deactivate the heat source and, should there be no heat losses to the external environment, it would be possible to maintain this position for an indefinite period of time. In practice it suffices to meet such losses in order to maintain this condition. In this stalemate condition the volume, temperature and pressure are maintained constant.

At the end of the preheating stage, the drying stage is started. This stage is carried out at variable volume by simply widening the open flow cross-section of the valve 9 while continuing to provide heat to the boards within the chamber 3 by means of the heating fluid circulating in the space 7. Thus, as a result of the opening of the valve 9, a quantity of steam escapes through this valve to the duct 8 while heat is continued to be supplied to the wood to make further steam evaporate from the latter. The steam leaving the duct 8 is condensed in the condenser 10 and, changed to the liquid phase, passes into the tank 12. The same quantity of steam per hour may alternatively be condensed in a container in the room 1. The open-flow cross-section of the valve 9 is easily regulable so as to maintain a substantially constant pressure within the chamber 3 whereby, consequently, thermodynamic changes occur substantially along an isotherm in the plane P, V, (FIG. 2) (or along a broken line very close to the said isotherm), represented by the section 2-3; an entirely similar result is obtained by regulating the discharge open-flow cross-section of the valve 9 so as to maintain the temperature within the said cavity substantially constant, the pressure remaining correspondingly constant.

It is noted that the point 3 on the isotherm $I_2$ is close to the point 3' on the limit curve; this indicates that the quantity of water vapour is nearly 1; in other words, under the conditions indicated at point 3, the water within the wood has been almost entirely changed to steam, except for that corresponding to the section 3-3' which corresponds to the desired final moisture content of the wood.

During the drying stage, the quantity of steam discharged may be within a very wide range between 0 and a maximum quantity. It is clear however that very low quantities necessitate long periods of time for effecting the drying process.

The maximum discharge quantity is easy to determine in practice by opening the valve 9 wider to the point at which the pressure in the room 1 tends to fall. The maximum quantity discharged clearly corresponds to the maximum quantity of water displaced from within the wood mass towards the exterior; this latter quantity obvious depends both on the type of wood and on the operating temperature. It is useful to note that the operating temperature of the process according to the invention is very high and hence the maximum discharge quantity may also be very high.

Quantities less than the maximum require longer drying times while greater quantities would result in damage to the wood.

The quantities of steam discharged per hour in terms of weight may conveniently be chosen within a range of between 0.2% and 5% of the weight of the dry wood within the chamber 3, depending on the species of wood. The most convenient quantity for achieving the optimum conditions described above is chosen on the basis of experimental data provided for each type of timber. It is easy to measure the quantity of water vapour extracted from the wood by weighing the condensate in the tank 12.

As has been described above, during the preheating stage according to the invention it is possible to heat both the surface and the interior of the wood to temperature above 100° C. while the surface of the wood is still moist: indeed, evaporation of water from the surface is avoided as a result of the pressure established in the room 1; thus all the heat given to the wood is used to increase its temperature.

In the subsequent drying stage the evaporation of water from the wood is regulated in dependence on the rate of displacement of the water from the interior towards the surface of the wood simply by operating the valve 9; hence the surface of the wood remains moist until the drying is finished because of the water supplied to it from the interior.

The drying stage described above may be interrupted at any point along the section 2-3 (FIG. 2) in order to start a further preheating stage which is continued until the timber is brought to a higher temperature than previously, on a further isotherm $I_3$; the initial and final conditions of the said stage are represented on the diagram of FIG. 2 by the points 4 and 5. After this further preheating, a further drying stage may be carried out at constant temperature and pressure until a desired final condition, represented by the point 5', is reached.

It is clear however that the process of the invention may include any desired number of successive preheating stages at substantially constant volume, and of drying stages at substantially constant temperature until a desired final condition is reached.

Similarly, a predetermined final condition, shown for example by point 7', may be obtained by interrupting the drying stage 2-3 at the point 6 and subjecting the wood to a cooling stage (achieved either by extracting heat from the chamber 3 or by reducing the pressure within the chamber), represented by the section 6-7; at this stage a further drying stage may be carried out along an isotherm $I_4$ represented by the section 7-7'.

Obviously, a succession of preheating, drying and cooling stages may be carried out, combined in any desired manner, provided that the points representing the limit conditions of the said stages are within the area between the vapour equilibrium curve a and the isotherm $I_O$ (at 100° C.) corresponding to atmospheric pressure, and hence provided that the conditions existing within the room 1 are those of saturated water vapor and the pressure is greater than atmospheric.

The time required for drying a predetermined mass of wood to very low moisture contents by the process of the invention is very small since the preheating stages described, in which no evaporation takes place but a quantity of heat accumulates within the mass of wood at a predetermined temperature at which evaporation might take place, takes very short periods of time, and the drying stages are also short since, during each of these drying stages, a quantity of water evaporates which is the maximum compatible with the type of wood treated.

The final moisture content of the dried wood, as well as being perfectly uniform, both in the central and in the surface parts, may also, because of the flow of water from the interior to the outer layers of the ligneous mass which is established during the course of the drying stages, be brought to very small values simply by discharging the water vapour to the exterior through the valve 9, until the limit points to the right of the sections of FIG. 2 (such as sections 2-3 and 5-5'), representative of the drying stages, approach the limit curve a, which being reached, the conditions corresponding to a quantity of water vapour equal to 1, in which no water exists in the liquid state in the wood (anhydrous wood) are achieved.

It is clear that the stages of the process and the parts of the apparatus which have been described may be modified and varied without departing from the scope of the invention.

We claim:

1. A high temperature process for drying wood in a room adapted to be hermetically sealed and having heated pressure resistant walls with suitable valve means extending therethrough comprising;

preheating said room in sealed condition to provide steam at a first pressure in said room above atmospheric pressure and heating the wood to a first predetermined temperature greater than 100° C. thereby preventing the evaporation of water from the wood and preventing condensation of water vapor on the walls of the room, and subsequently discharging a metered quantity of steam from said room through said valve means while simultaneously supplying sufficient heat to said room to maintain said first pressure and said first temperature substantially unaltered to remove water from said wood.

2. A process according to claim 1, wherein the quantity of steam discharged into the external atmosphere is choosen so as to be substantially equal to the quantity of water which is displaced from the interior towards the surface of the mass of wood under the conditions of temperature and pressure in said room.

3. A process according to claim 2, wherein said quantity of steam discharged into the external environment is between 0.2% and 5% of the dry weight of the wood placed in said room.

4. A process as set forth in claim 1, further comprising an additional preheating step initiated subsequent to the initiation of steam discharge comprising halting the discharge of steam to the external environment and supplying heat to the room so as to bring the entire mass of wood to a second temperature higher than said first temperature and the steam to a second pressure higher than said first pressure and subsequently discharging the metered quantity of steam from said room through said valve means while simultaneously supplying sufficient heat to the room to maintain said second pressure and said second temperature substantially unaltered to remove water from said wood.

5. A process according to claim 1, further comprising a cooling step initiated subsequent to said discharging of a metered quantity of steam including reducing the supply of heat to bring the entire mass of wood to a second temperature which is lower than said first temperature and to lower the pressure of the steam to a second pressure which is lower than said first pressure but greater than atmospheric pressure and further discharging a metered quantity of steam from said room through said valve means while simultaneously supplying sufficient heat to the room necessary to maintain said second pressure and said second temperature substantially unaltered to remove water from said wood.

* * * * *